US007070319B2

(12) United States Patent
Peterman, Jr.

(10) Patent No.: US 7,070,319 B2
(45) Date of Patent: Jul. 4, 2006

(54) SAMPLE ROTATOR WITH FIXED SAMPLING POINT

(76) Inventor: John William Peterman, Jr., 1910 Mayflower Dr, Middleton, WI (US) 53562

( * ) Notice: Subject to any disclaimer, the term of this patent is extended or adjusted under 35 U.S.C. 154(b) by 139 days.

(21) Appl. No.: 10/700,760

(22) Filed: Nov. 4, 2003

(65) Prior Publication Data

US 2004/0095845 A1 May 20, 2004

Related U.S. Application Data

(60) Provisional application No. 60/423,451, filed on Nov. 4, 2002.

(51) Int. Cl.
*B01F 9/10* (2006.01)

(52) U.S. Cl. ..... 366/213; 366/233

(58) Field of Classification Search ..... 366/208–220, 366/233

See application file for complete search history.

(56) References Cited

U.S. PATENT DOCUMENTS

| | | | | | |
|---|---|---|---|---|---|
| 1,414,197 | A | * | 4/1922 | Maddox | 366/208 |
| 1,445,488 | A | * | 2/1923 | Clark | 366/233 |
| 1,983,164 | A | * | 12/1934 | Bush | 366/208 |
| 2,006,451 | A | * | 7/1935 | Glidden | 366/213 |
| 2,185,979 | A | * | 1/1940 | Dumas | 99/423 |
| 2,346,613 | A | * | 4/1944 | Rumsey, Jr. | 53/370 |
| 2,653,015 | A | * | 9/1953 | Andrews | 366/213 |
| 2,757,911 | A | * | 8/1956 | Varady | 366/60 |
| 2,874,873 | A | * | 2/1959 | Newell | 221/203 |
| 2,944,799 | A | * | 7/1960 | Larson | 366/57 |
| 3,097,834 | A | * | 7/1963 | Hurst | 366/233 |
| 3,194,542 | A | * | 7/1965 | Pfeifer | 366/235 |
| 3,578,292 | A | * | 5/1971 | Montague | 366/60 |
| 3,669,433 | A | * | 6/1972 | Hurst | 366/233 |
| 3,711,379 | A | * | 1/1973 | Adams | 435/303.3 |
| 3,734,470 | A | * | 5/1973 | Dreher | 366/200 |
| 3,764,112 | A | * | 10/1973 | Jelley | 366/233 |
| 3,777,652 | A | * | 12/1973 | Engel | 99/275 |
| 3,830,475 | A | * | 8/1974 | Inoue et al. | 366/145 |
| 4,173,418 | A | * | 11/1979 | Vork | 366/128 |
| 4,227,794 | A | * | 10/1980 | Tabin | 396/573 |
| 4,229,138 | A | * | 10/1980 | Hurst | 414/787 |
| 4,277,185 | A | * | 7/1981 | Thompson | 366/213 |
| 4,281,936 | A | * | 8/1981 | Schotter et al. | 366/209 |
| 4,307,965 | A | * | 12/1981 | Catarious et al. | 366/208 |
| D263,307 | S | * | 3/1982 | Collins | D15/147 |
| 4,669,274 | A | * | 6/1987 | Huang | 62/342 |
| 4,754,658 | A | * | 7/1988 | Gutknecht | 74/665 L |
| 4,785,727 | A | * | 11/1988 | Miyata et al. | 99/535 |
| 4,785,728 | A | * | 11/1988 | Miyata et al. | 99/535 |
| 5,299,864 | A | * | 4/1994 | Reynolds et al. | 366/233 |
| 5,300,438 | A | * | 4/1994 | Augspurger et al. | 435/290.3 |
| 5,884,999 | A | * | 3/1999 | Muzzio et al. | 366/219 |
| 6,325,533 | B1 | * | 12/2001 | Kelley | 366/219 |
| 6,450,681 | B1 | * | 9/2002 | Nettelhoff et al. | 366/348 |
| 6,948,844 | B1 | * | 9/2005 | Zeeper | 366/213 |

FOREIGN PATENT DOCUMENTS

| | | | |
|---|---|---|---|
| DE | 2713678 | * | 10/1978 |
| JP | 54-86674 | * | 7/1979 |

* cited by examiner

*Primary Examiner*—Charles E. Cooley

(57) ABSTRACT

A device for holding and rotating cylindrical sample containers for use in analytical instrumentation. The device maintains the surface of material in the container at a constant location during rotation by using a series of fixed contact points. The drive wheel is tension to secure the sample container to the fixed supports and to automatically accommodate different size containers without adjustment.

4 Claims, 6 Drawing Sheets

SAMPLE ROTATOR WITH FIXED SAMPLING POINT

CROSS-REFERENCE TO RELATED APPLICATIONS

Figure 1A:
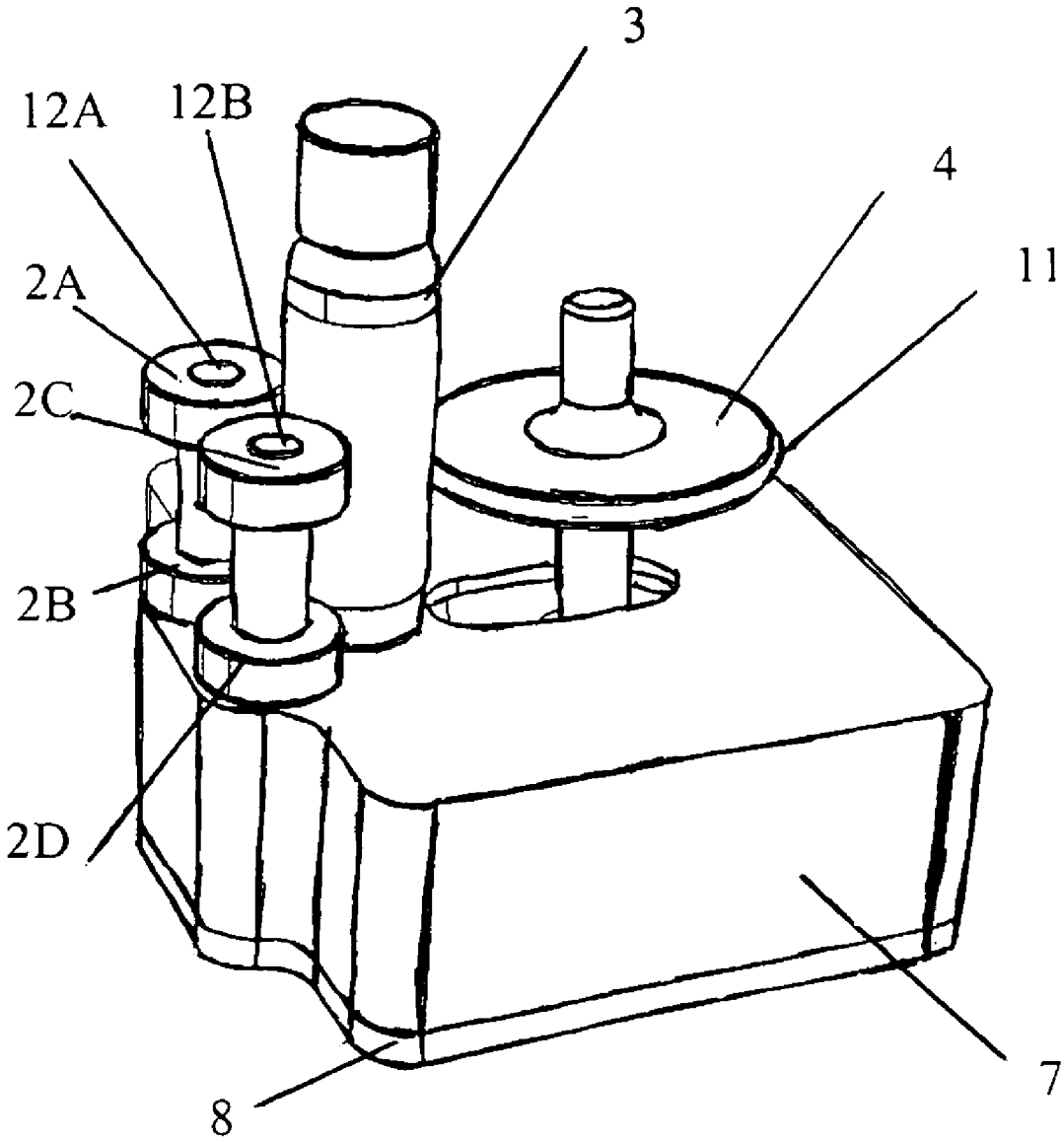

This application claims the benefit of PPA Ser. Nr. 60/423,451 filed Nov. 4, 2002 by the present inventor

FEDERALLY SPONSORED RESEARCH

Not Applicable

SEQUENCE LISTING OR PROGRAM

Not Applicable

BACKGROUND OF THE INVENTION—FIELD OF INVENTION

This invention relates to sampling methods used in analytical instrumentation.

BACKGROUND OF THE INVENTION

Rotation of samples placed in many chemical analyzers is important for obtaining good analysis results. Analyzers possess a location where the sample is placed, which for this discussion will be called the sampling point. This is typically a small, precise location defined by an analyzing beam or a focal point or a combination of these and other factors. Since this point is small, the amount of sample analyzed is also quite small and many not represent the properties of the bulk sample. This problem can be reduced by constantly moving the sample to analyze a greater proportion. In practice, this is often done by placing the sample in cylindrical sample containers such as tubes or vials and rotating it as it is analyzed. The resulting signal is an integration of the results from the material that is rotated into the sampling point and is therefore more representative of the whole. In some cases where the analyzing beam can heat or otherwise affect the sample if it is on the same material for too long of time, rotation can also be used to present new material to the analyzing beam thus reduce its adverse effects. Since the sampling point is a precise location, the position of the sample within the sample container must consistently remain at the sampling point of the instrument for good results during rotation.

Prior designs of sample rotators use a chuck or circular holder for the sample container. Changing to different size sample containers require changing to a different chuck or changing settings on an adjustable chuck. The sample containers must be carefully centered within the chuck on the axis of rotation since any deviation will move the material in the sample container from the sampling point as it is rotated and will affect the data collected. Prior designs necessitate the use of a small chuck that holds the sample container from the bottom and leaving the top of the container unsupported to avoid obstructing the instruments view of the sampling point during rotation, allowing the potential for the container to tip or move during rotation.

BACKGROUND OF THE INVENTION—OBJECTS AND ADVANTAGE

The new invention was designed overcome a number of the disadvantages of the previous design. It automatically adjusts to continuously accommodate any size cylindrical sample container from a minimum to a maximum size. There is no need to adjust the location of the axis of rotation since the material in the sample container is held at the sampling point during rotation. The design provides better support as the sample container is held multiple points at different heights and locations greatly reducing the potential tipping or movement during rotation.

The system works by having fixed contact points that retain the sample container on one side while it is pushed by a movable, tensioned drive wheel on the other. The surface of the material within the sample container is maintained at a constant point in space defined by the location of the fixed contact points. These fixed contact points consist of four points, two on each side of the sample container with two below and two above the sampling point. The locations of the fixed points are placed so as to not obstruct the analysis equipment's view of the sampling points and yet retain the sample container.

SUMMARY

The present invention through the use of fixed contact points to determine the location of the material in a cylindrical sampling container during rotation, alleviates a number of problems associated with prior designs.

DRAWINGS—FIGURES

FIG. 1A left side view of the device with a sample container in place

Figure 1B:
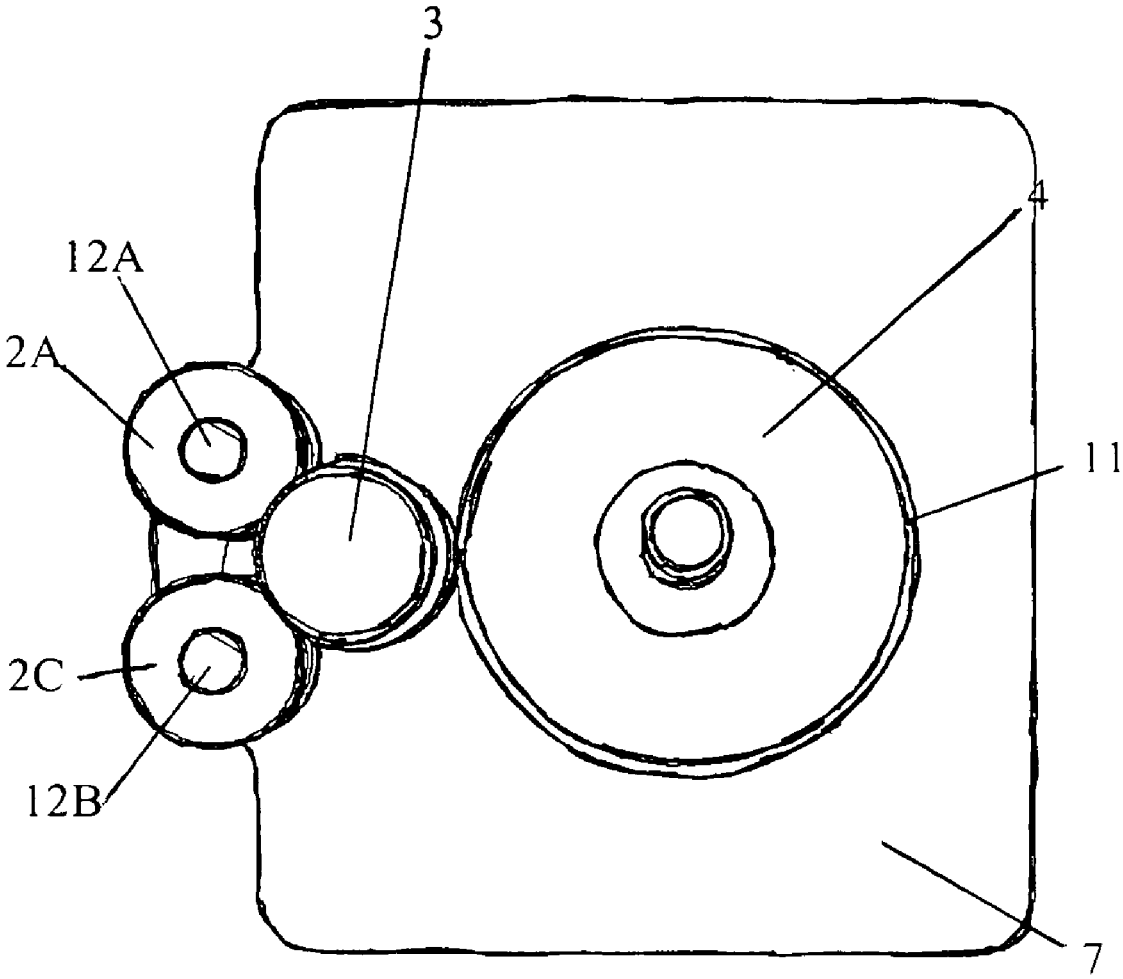

FIG. 1B a top view of the device with a sample container

Figure 1C:
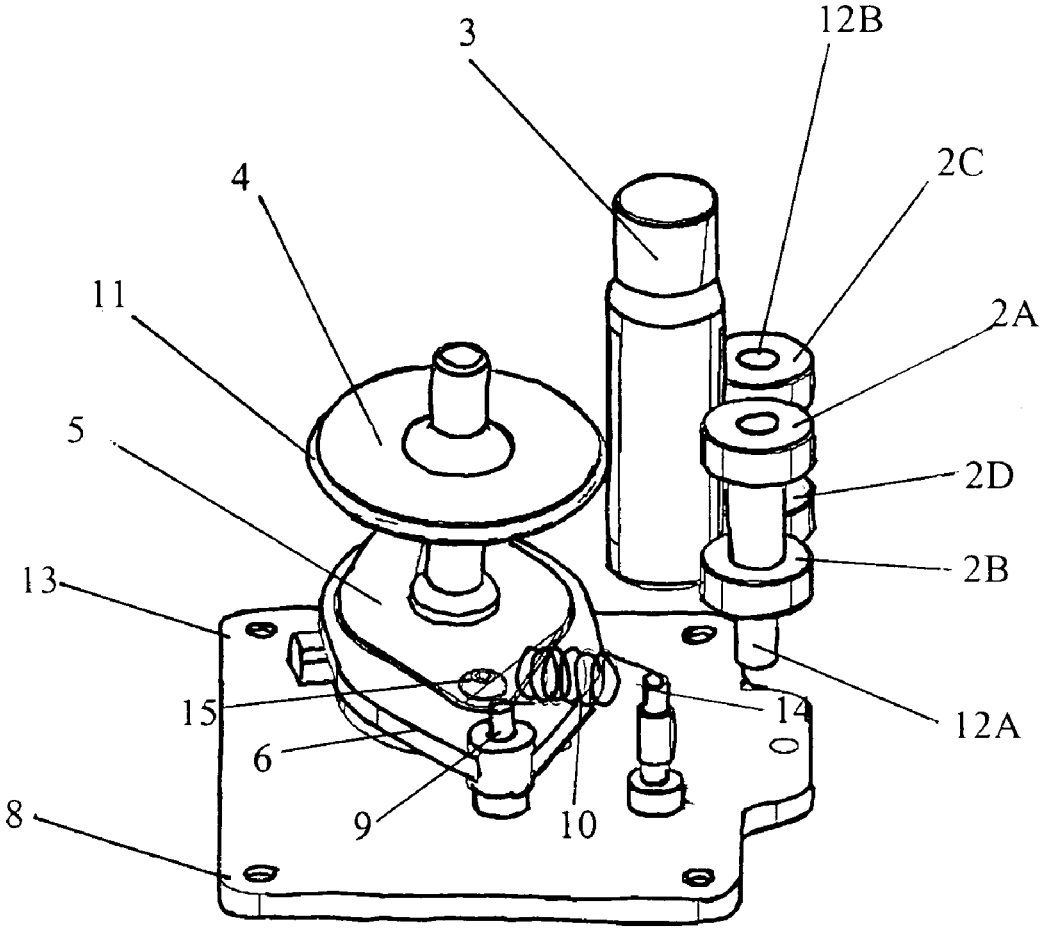

FIG. 1C right side view with the Top Case removed showing the internal components.

FIG. 1D front view

Figure 2A:
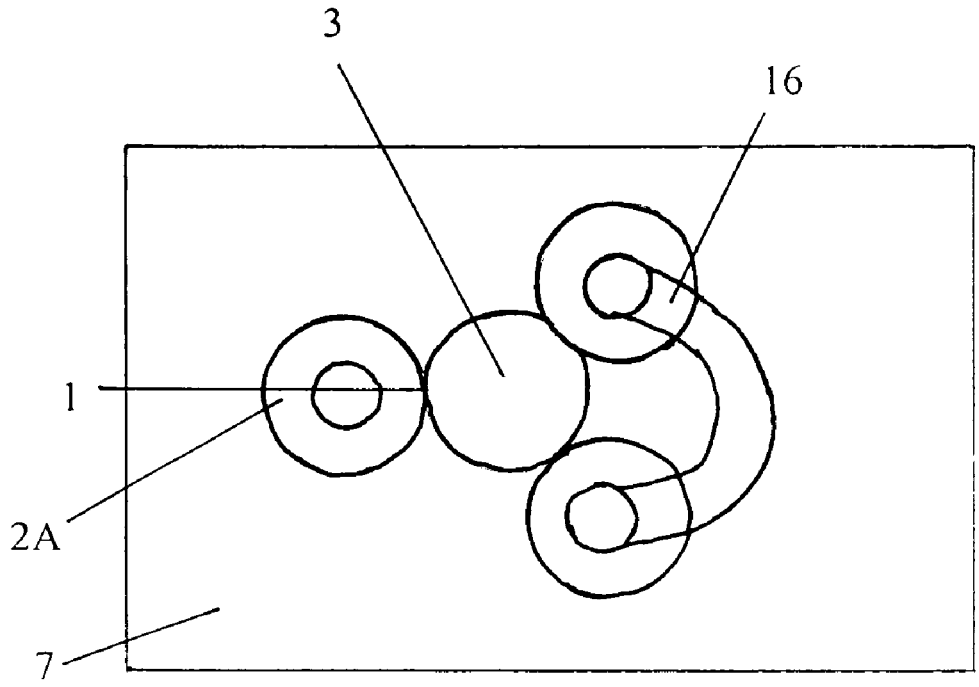
Figure 2B:
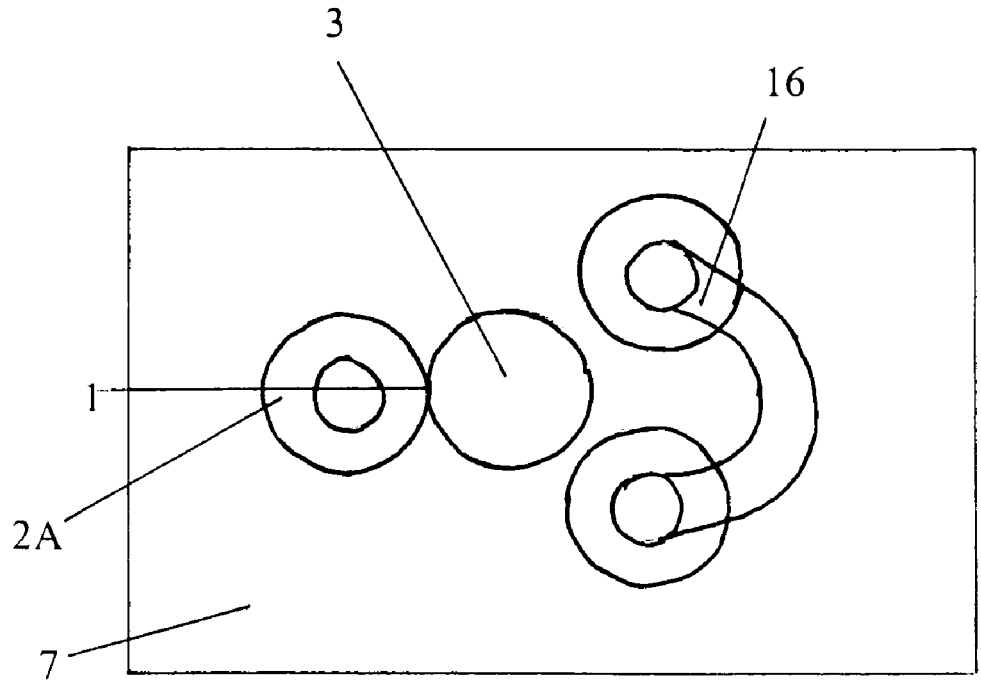

FIG. 2A, FIG. 2B top view of single fixed contact point embodiment

Figure 3:
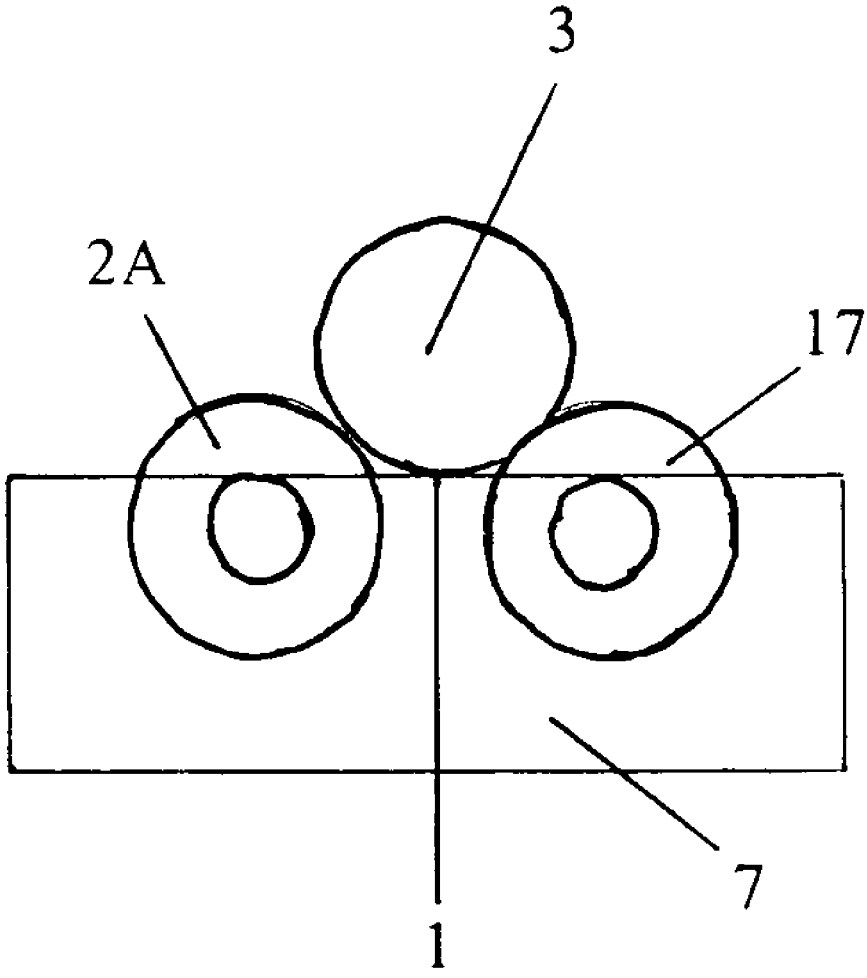

FIG. 3 End view of sideways held sample container embodiment

DRAWINGS—REFERENCE NUMBERS

1 Sampling Point
2A, 2B, 2C, 2D Fixed contact points
3 Sample container
4 Drive Wheel
5 Motor
6 Motor mount
7 Top case
8 Bottom Plate
9 Pivot point
10 Spring
11 O-Ring
12A, 12B Shafts
13 Motor wires
14 Spring Post
15 Motor and spring screw
17 Dual wheel drive assembly

DETAILED DESCRIPTION—FIGS. 1, FIG. 2, FIG. 3 AND FIG. 4—PREFERRED EMBODIMENT

Figure 1D:
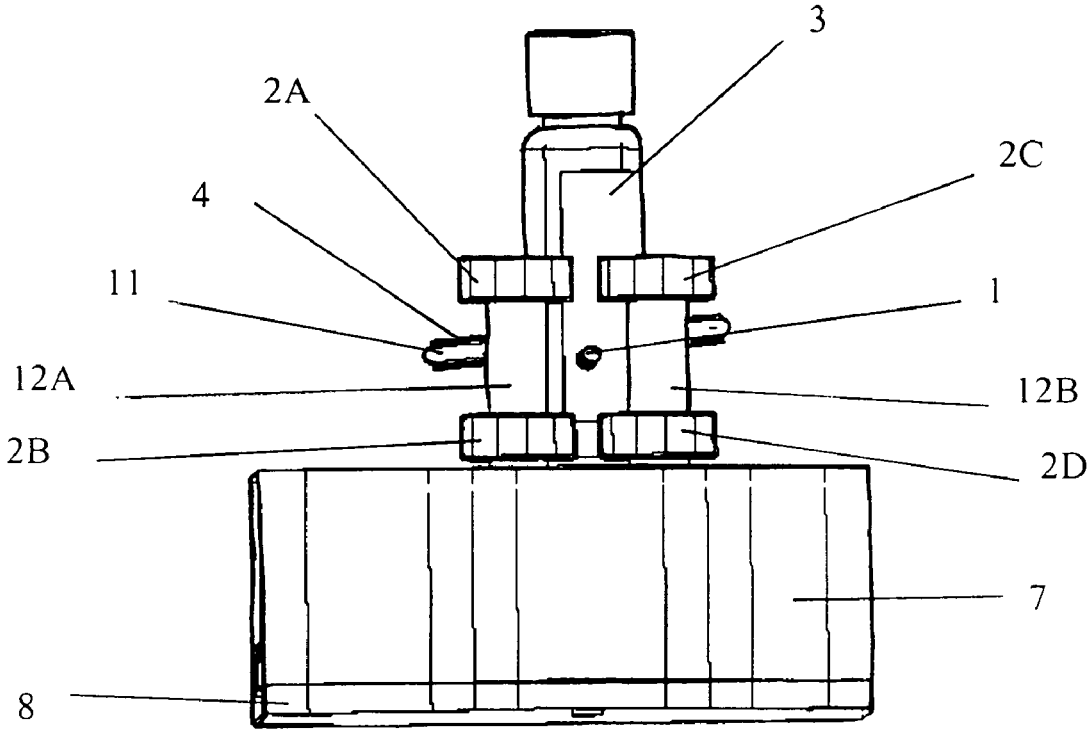

The preferred embodiment of the system is illustrated in FIG. 1A through FIG. 1D. The device as shown in FIG. 1A (left side view) consists of two pair of fixed contact points 2A, 2B, 2C, 2D in this case using rotational bearings, mounted on two shafts 12A, 12B for the sample container 3 to rest against. The container 3 is held in place by the drive wheel 4 which can move towards and away from the fixed contact points 2A, 2B, 2C, 2D and is spring tensioned. For increased friction between the drive wheel 4 and the sample container 3, a rubber O-ring 11 is used. The use of rotational bearings for the contact points 2A, 2B, 2C, 2D, and the o-ring 11, is not required for operation, but steps need to be taken to ensure that the friction between the drive wheel 4, and the Sample container 3, is greater than the friction between the contact points 2A, 2B, 2C, 2D and the sample container 3. In FIG. 1B (top view), it can be seen that the sample container 3 is held in place by the arrangement of fixed contact points 2A, 2B, 2C, 2D and drive wheel 4. FIG. 1C (right side view) shows the spring loaded mechanism that provides the force to hold the sample container 3 and allows for accommodation of different size containers. The drive wheel 4 is attached to the motor 5 which is held by the motor mount 6. The Motor mount 6 is held by a single pivot point 9, and tension to hold the sample container 3 is proved by a spring 10 connected between the motor and spring screw 15 and the spring post 14. The motor in this example is a standard 12 volt stepper motor available from Danaher Motion and a variety of other sources, driven by a standard stepper motor controller circuit. A geared DC motor also available from Danaher Motion and many other sources could also be used. The maximum rotational speed required for this device is very low, on the order of several rpm, (revolutions per minute). While running at higher RPM would still work, it would contribute to unwanted vibration, so the motor selected should be able to operate at very low rotational speeds. FIG. 1D (front view) shows the position of the sampling point 1 on the sample container 3 and vertical and horizontal separation of the fixed contact points to provide the instrumentation an unobstructed view of the sampling point 1. FIG. 1D (front view) also shows the Drive wheel 4, is put at a slight angle, which when rotated in this case clockwise, applies a slight downward force to prevent the sample container 3 from walking up during rotation.

DESCRIPTION—ADDITIONAL EMBODIMENT

FIG. 2A and FIG. 2B (top view) shows an embodiment of the device where the fixed contact point 2A is on the same axis as the sampling location 1 and the movable portion is the dual wheel drive assembly 16. The dual wheel assembly can have either both wheels or a single wheel powered, but both are moved together as shown in the change of position from FIG. 2A to FIG. 2B to hold the sample container against fixed contact point 2A. This configuration provides better tracking of the front surface.

In FIG. 3 (end view) shows an embodiment of the device with the sample container on its side so the sample location 1 is facing down. This can be useful in cases where there is not much sample in the sample container. Gravity holds the sample container 3 in place against the fixed contact points. One or more of the contact points are motorized to provide the rotation.

Conclusion Ramifications and Scope

From the preceding discussion, it can be seen that the invention represents a number of advantages over prior versions of sample rotators.

- Better maintenance of the sample material at the sampling point
  - No need to align container to the axis of rotation
  - More contact points particularly vertically to better secure the sample container
- Automatic adjustment to different size containers Thus the scope of the invention should be determined by the appended claims and their legal equivalents, rather then by the examples given.

I claim:

1. An apparatus for rotating a container about a vertical axis comprising:

a housing;

two generally parallel shafts extending substantially vertically from said housing, said shafts being fixed to said housing;

at least one rotatable container contacting element mounted on each of said shafts;

a drive means mounted within said housing, the drive means rotating a drive wheel about a vertical axis; the drive means pivoting about a pivot point within said housing and having tensioning means for pivoting the drive wheel into forcible engagement with said container;

wherein containers of various sized can be rotated about a fixed vertical axis between said pivoting drive wheel and said contacting elements.

2. An apparatus for rotating a container about a vertical axis in accordance with claim 1, wherein a portion of said drive wheel has a friction surface thereon for engaging said container.

3. An apparatus for rotating a container about a vertical axis in accordance with claim 1, wherein each said shaft has two rotatable container contacting elements mounted thereon.

4. An apparatus for rotating a container about a vertical axis in accordance with claim 1, wherein the tensioning means comprises a spring.

* * * * *